US012428936B1

(12) United States Patent
Provost

(10) Patent No.: US 12,428,936 B1
(45) Date of Patent: Sep. 30, 2025

(54) FLOW CONTROL TOOL, METHOD AND SYSTEM

(71) Applicant: Baker Hughes Oilfield Operations LLC, Houston, TX (US)

(72) Inventor: Wilfred Provost, Tomball, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/618,320

(22) Filed: Mar. 27, 2024

(51) Int. Cl.
*E21B 43/04* (2006.01)

(52) U.S. Cl.
CPC ..... *E21B 43/045* (2013.01)

(58) Field of Classification Search
CPC ..... E21B 43/045
See application file for complete search history.

(56) References Cited

U.S. PATENT DOCUMENTS

| | | | | |
|---|---|---|---|---|
| 8,813,850 | B2 | 8/2014 | Geoffroy | |
| 10,323,488 | B2 | 6/2019 | Richards | |
| 2003/0164237 | A1* | 9/2003 | Butterfield, Jr. | E21B 33/05 166/70 |
| 2011/0067862 | A1 | 3/2011 | Clem et al. | |
| 2011/0079398 | A1* | 4/2011 | Patel | E21B 37/06 166/373 |
| 2011/0315389 | A1* | 12/2011 | Crider | E21B 21/103 166/329 |
| 2013/0043042 | A1* | 2/2013 | Flores | E21B 34/142 166/194 |
| 2013/0048303 | A1* | 2/2013 | Patel | E21B 41/02 251/28 |
| 2015/0129205 | A1* | 5/2015 | Hofman | E21B 34/103 166/250.01 |
| 2016/0123113 | A1* | 5/2016 | Allen | E21B 43/26 166/308.1 |
| 2017/0175487 | A1* | 6/2017 | Marcin | E21B 34/14 |
| 2017/0218724 | A1 | 8/2017 | Brasseaux | |
| 2018/0094508 | A1* | 4/2018 | Smith | E21B 43/26 |

(Continued)

FOREIGN PATENT DOCUMENTS

| | | |
|---|---|---|
| GB | 2547331 A | 8/2017 |

OTHER PUBLICATIONS

International Search Report and Written Opinion issued in PCT Application No. PCT/US2025/021524, mailed on Jul. 11, 2025 (14 pages).

*Primary Examiner* — Taras P Bemko
(74) *Attorney, Agent, or Firm* — Baker Hughes Patent Organization

(57) ABSTRACT

A flow control tool includes a housing, a mandrel in the housing, the mandrel supporting a plurality flow control units (FCU), and a seal between the housing and the mandrel. A method for managing flow includes shifting a mandrel having a plurality of Flow Control Units (FCU) into a position that causes an FCU of the plurality of FCUs to be in an operational position, and then shifting a different FCU of the plurality of FCUs into an operational position. A gravel pack assembly includes the flow control tool. A method for gravel packing includes operating a gravel pack assembly in an open mode, operating the gravel pack assembly in a check mode, and operating the gravel pack assembly in a closed mode. A borehole system includes a borehole in a subsurface formation, a string in the borehole, and a tool, disposed within or as a part of the string.

18 Claims, 12 Drawing Sheets

(56) References Cited

U.S. PATENT DOCUMENTS

| | | | | |
|---|---|---|---|---|
| 2018/0320478 | A1* | 11/2018 | Themig | E21B 34/12 |
| 2020/0063511 | A1* | 2/2020 | McGuire | E21B 34/142 |
| 2022/0259942 | A1* | 8/2022 | Provost | E21B 43/26 |
| 2024/0218759 | A1* | 7/2024 | Werries | E21B 34/102 |

* cited by examiner

FLOW CONTROL TOOL, METHOD AND SYSTEM

BACKGROUND

In the resource recovery and fluid sequestration industries efficiency of motion is an ever-present concern. Flow control is also quite important in the industry and requires a number of different types of devices to effect control in a desirable way. Different tools are generally run to depth to manage a flow in the desired way and changed out over the life of the well as pressures and flow rates change. Advancements are always well received in the art.

SUMMARY

An embodiment of a flow control tool including a housing, a mandrel disposed in the housing, the mandrel supporting a plurality of discrete flow control units (FCU), and a seal disposed between the housing and the mandrel, the mandrel and housing being movable relative to one another to position the seal in an operative position for one of the plurality of FCUs.

An embodiment of a method for managing flow in a borehole includes shifting a mandrel having a plurality of discrete Flow Control Units (FCU) disposed therein into a position relative to a housing where a seal between the housing and the mandrel causes an FCU of the plurality of FCUs to be in an operational position, modifying a flow of fluid by passing the fluid through the FCU, and shifting a different FCU of the plurality of FCUs into an operational position.

An embodiment of a gravel pack assembly includes a crossover tool, the tool, connected to the crossover tool, a packer connected to the crossover tool, a first seal bore formed within the packer, a port housing connected to the packer, and a second seal bore connected to the port housing wherein the plurality of FCU's includes a check valve, and a plug, the assembly configured to change directly from check to closed.

An embodiment of a method for gravel packing includes operating a gravel pack assembly in an open mode, operating the gravel pack assembly in a check mode, and operating the gravel pack assembly in a closed mode.

An embodiment of a borehole system includes a borehole in a subsurface formation, a string in the borehole, and a tool, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
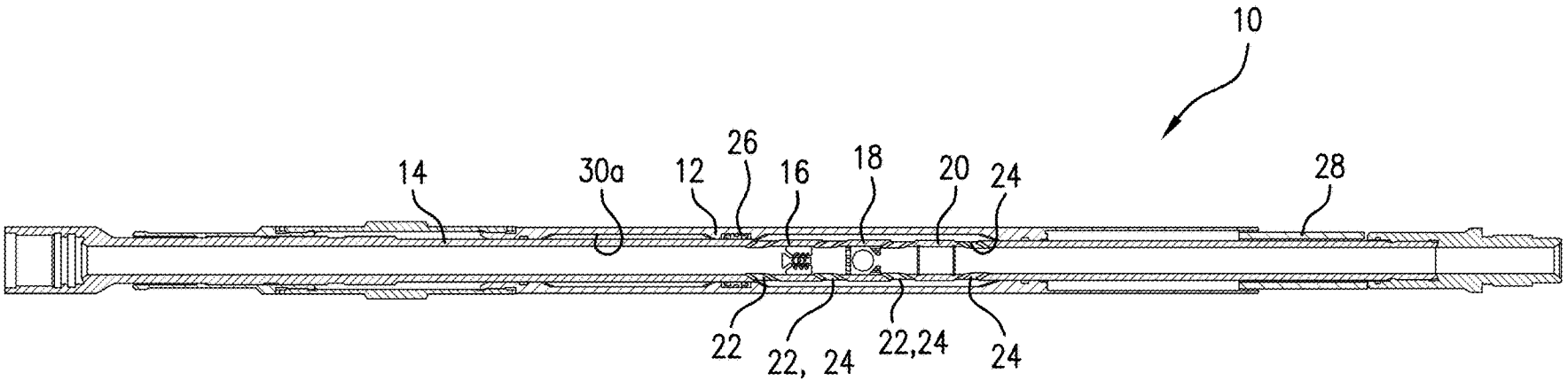
FIG. 1 is a sectional view of a first embodiment of a flow control tool in an open position.
Figure 1A:
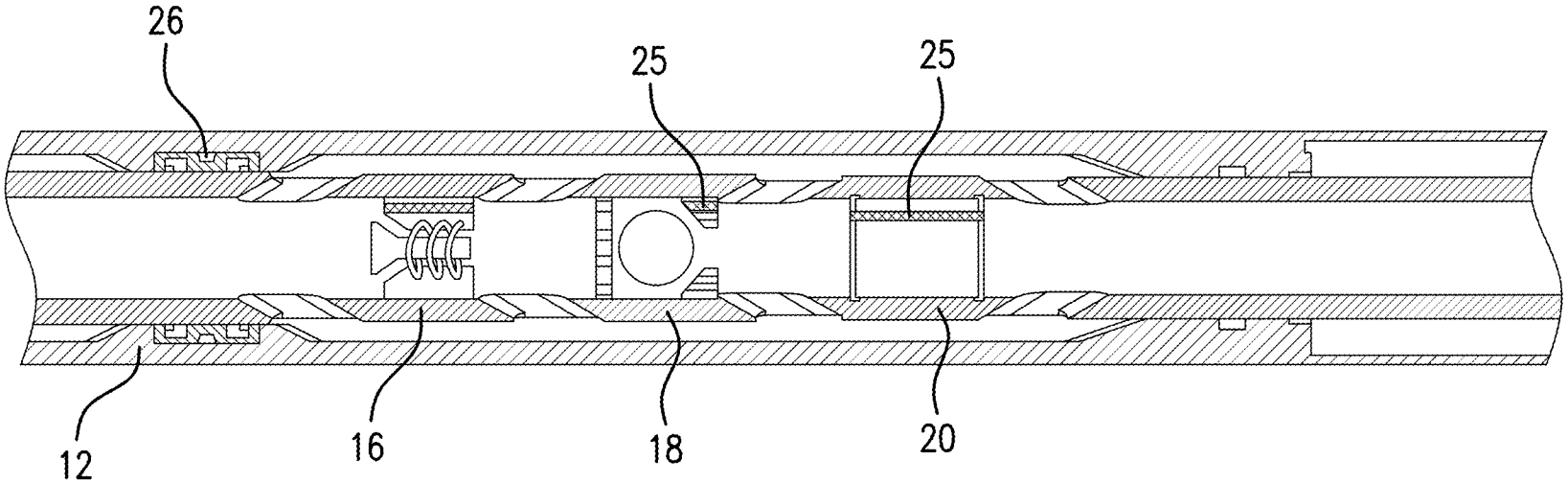
FIG. 1A is an enlarged view of a portion of FIG. 1.

Referring to FIGS. 1-4, a first embodiment of a flow control tool 10 is illustrated. Tool 10 comprises a housing 12 and a mandrel 14 disposed in the housing 12. The mandrel 14 supports a plurality of discrete flow control units (FCU) 16, 18, and 20. Two or more FCUs are contemplated, with three specifically illustrated as one example. The FCUs may be configured mechanically to manage a number of different parameters of the flow. For example, as illustrated FCU 16 is a flow regulator, FCU 18 is a check valve, and FCU 20 is a plug. Other types of FCU are also contemplated including but not limited to a back pressure valve, relief valve, orifice, choke, etc. Each FCU also includes bypass ports 22 and 24 upstream and downstream (respectively or in reverse depending upon flow direction) of the operative portion thereof (i.e. the flow regulator or check valve, etc.) Note that where two FCUs are beside one another, a single port structure between them will serve as both port 24 and port 22. Optionally, in some embodiments, FCUs may also comprise a weephole 25 to allow some fluid passage even if in a checked or plugged position (see FIG. 1A). A seal 26 is disposed between the housing 12 and the mandrel 14. The seal 26 is of a dynamic type allowing fluid isolation while also allowing movement between the housing 12 and the mandrel 14. The seal may be mounted to either the housing or the mandrel, or could be floating therebetween, in embodiments, but is illustrated as mounted to the housing 12. The housing 12 and mandrel 14 also have interacting between them an indexer 28, such as a J-slot. Accordingly, the positions of the mandrel and housing are selectable by picking up and slacking off on the string of which the tool 10 is a part. As will be appreciated by one of ordinary skill, the tool 10 is generally employed in a casing string and so may use profiles in on the casing or on the tool 10 to interact with the casing thereby supporting the movement of the housing 12 relative to the mandrel 14.

The housing 12 further includes a bypass area 30 (30*a*, 30*b*) that functions to allow fluid to flow around one or more of the plurality of FCUs thereby bypassing those FCUs and not affecting the flow with whatever the particular FCUs are capable of doing. In embodiments, the bypass area 30 will be as long as the number of FCUs that are present to ensure that if the FCUs are positioned within the bypass area 30, none of them would be active. This is the case illustrated in FIG. 1 and hence, the tool 10 is termed open in FIG. 1.

Figure 2:
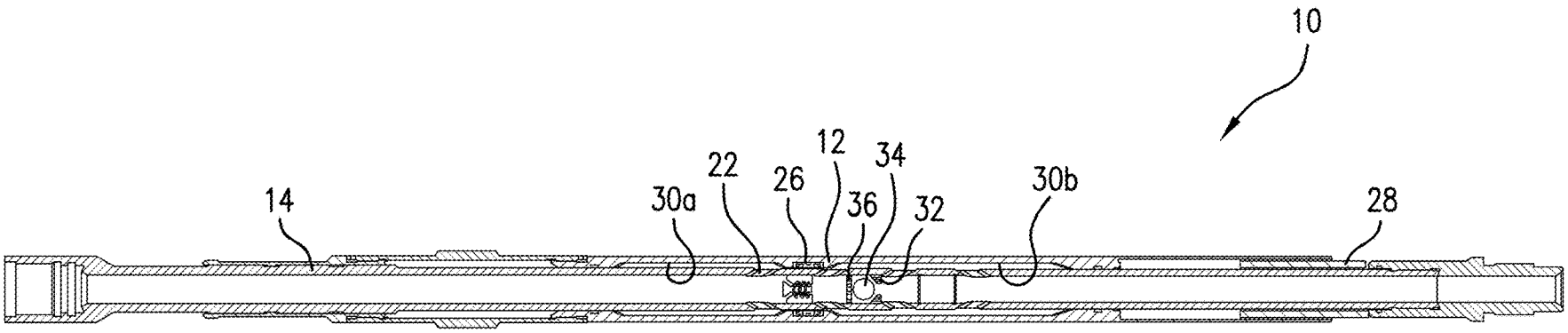
FIG. 2 is a sectional view of the tool of FIG. 1 in a rate limited position.

Cycling (pick up and slack off) the indexer 28 (or otherwise just moving the mandrel relative to the housing, such as with hydraulics or shifting tool) to position FCU 16 in an operable position including sealing to seal 26, as illustrated in FIG. 2. FCU 16, in the illustrated embodiment, is a flow regulator. FCU 16 is shown with its bypass ports 22 and 24 on either axial side of the seal 26. Accordingly, a fluid flow in the mandrel 14 must flow through the FCU rather than around it. In the position of FIG. 2, flow in the mandrel 14 will necessarily be rate limited due to the configuration of FCU 16.

Figure 3:
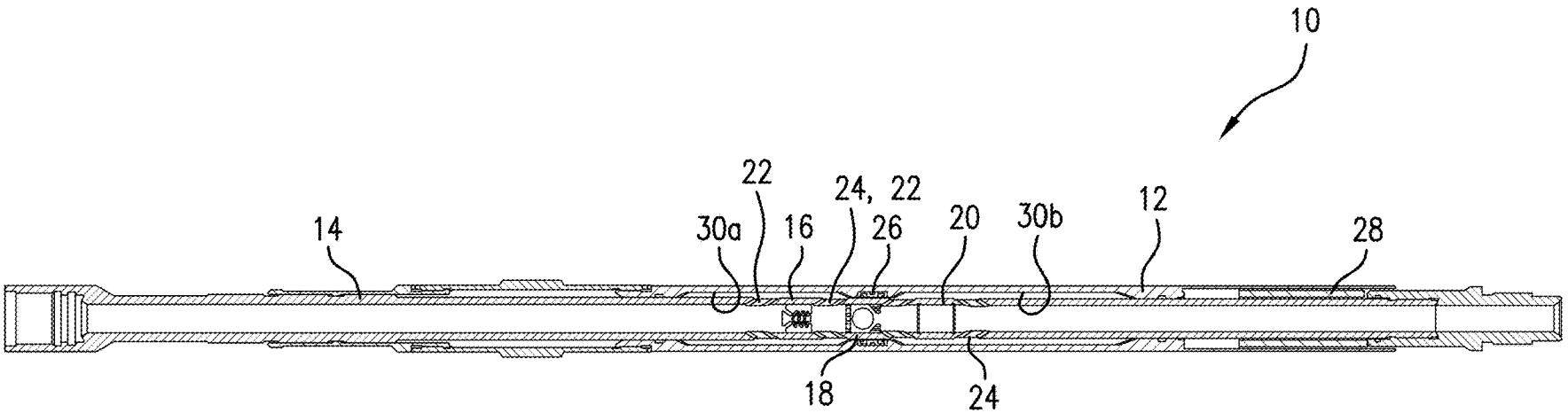
FIG. 3 is a sectional view of the tool of FIG. 1 in a check position.

In FIG. 3, another position of the same embodiment moves the FCU 16 out of sealing engagement with seal 26 and moves both ports 24 and 26 for FCU 16 into the bypass area 30 adjacent and to the left (in the figure) of the seal 26. In this position, flow will exit the mandrel 14 upstream of the FCU 16 and reenter the mandrel 14 downstream of the FCU 16 while FCU 16 will have a negligible effect on the flow through tool 10. FCU 18 is disposed in the seal 26, exposing one port 24 on one side of seal 26 to one bypass area 30*a* and the other bypass 26 in a different bypass area 30*b*. Flow then must run through FCU 18, which as illustrated is a check valve. Fluid can flow in FIG. 3 from right to left but not vice versa. In one embodiment, the check valve is a trapped ball type having a seat 32, a ball 34 and a baffle 36.

Figure 4:
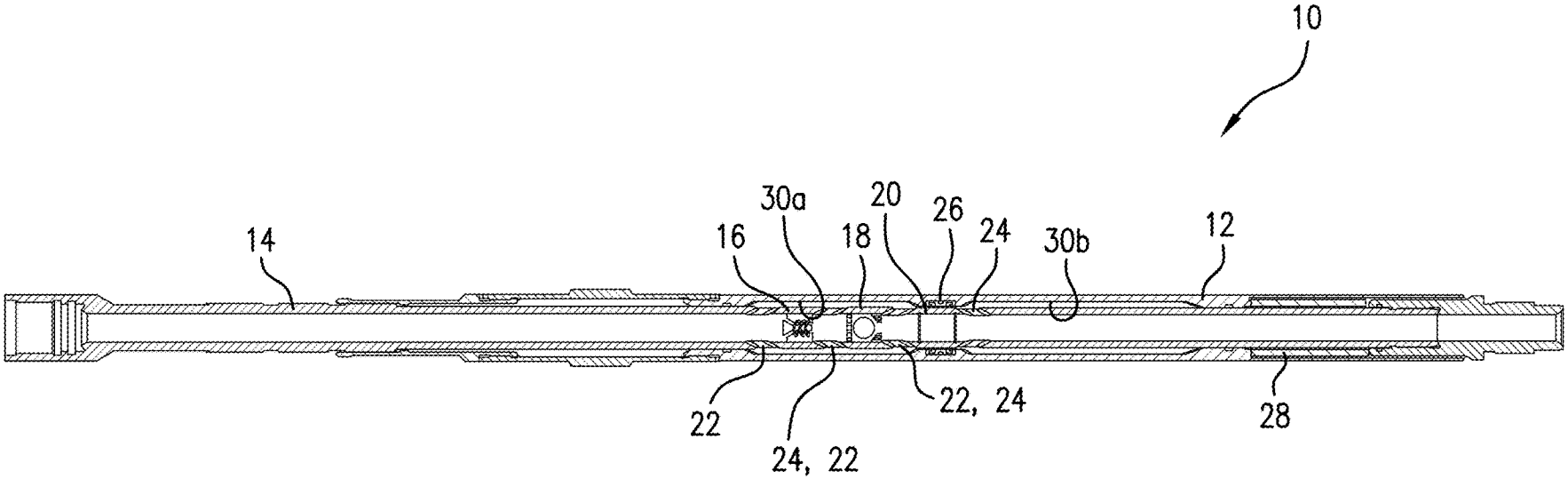
FIG. 4 is a sectional view of the tool of FIG. 1 in a closed position.

Referring to FIG. 4, another movement between housing 12 and mandrel 14 (happening to be in the same direction in the Figures but other directions are contemplated as any of the FCUs may be selected and in any order one might way to employ them), FCU 20 has moved into position with the seal 26 similarly to the way the foregoing FCUs discuss have done. In this position, the tool 10 is closed because the FCU 20 is a plug.

Figure 5:
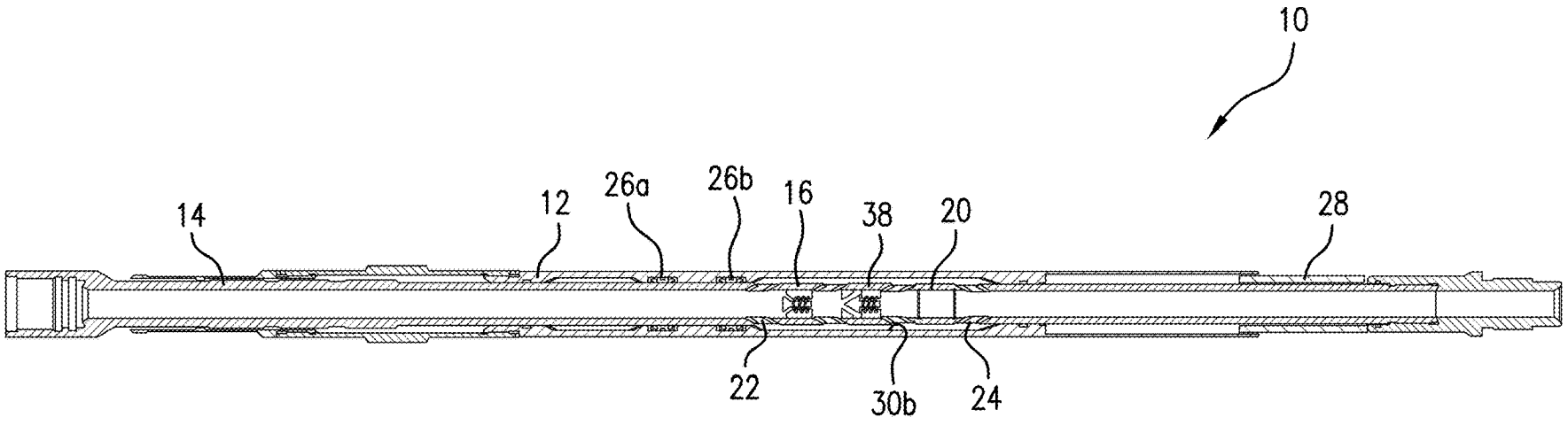
FIG. 5 is a sectional view of a second embodiment of a flow control tool in an open position.

Referring to FIG. 5, another embodiment of tool 10 is illustrated. This embodiment differs from the forgoing embodiment in that two seals 26*a* and 26*b* are employed in this embodiment. This embodiment allows the employment of two FCUs in series as well as just one at a time. It will be appreciated that FCU 16 and FCU 20 are the same but a different FCU 38, a back pressure valve, is illustrated. It is reiterated that any combination of FCUs may be employed and that they need not all be different. One or more may be the same as each other and may be placed (among a number of adjacent FCUs) for easier access thereto as a sequence operation. FIG. 5 is in an open position. Similar to FIG. 1, bypass ports 24 and 26 for each of the FCUs are disposed within one bypass area 30, hence allowing fluid to flow around the FCUs.

Figure 6:
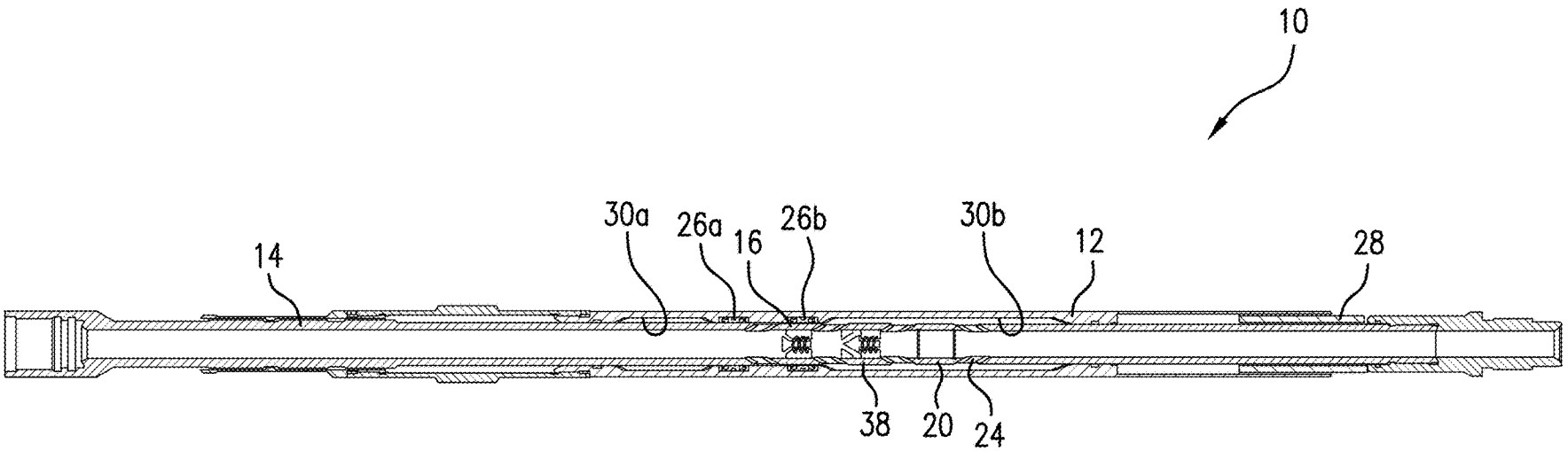
FIG. 6 is a sectional view of the tool of FIG. 5 in a position employing a first flow control unit.
Figure 7:
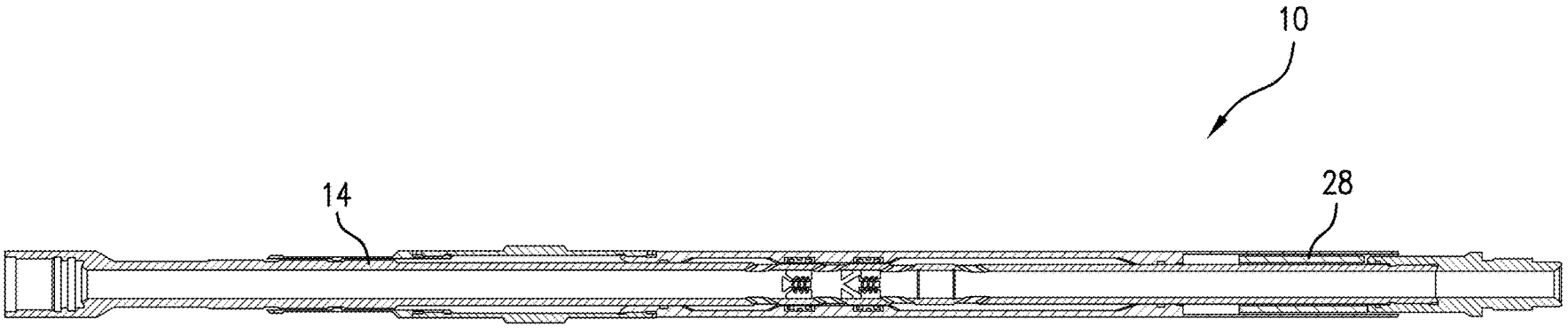
FIG. 7 is a sectional view of the tool of FIG. 5 in a position employing two flow control units in series.

Referring to FIG. 6 illustrates a position where the second embodiment operates similarly to that of FIG. 2. FCU 16 is disposed in sealing contact with seal 26*b*, essentially duplicating the action illustrated in FIG. 2. In FIG. 7, however, FCU 38 is moved into sealing contact with seal 26*b* and FCU 16 is moved into sealing contact with seal 26*a*. In this position, port 22 is in bypass area 30*a*, while port 24 (port 22 for FCU 38) is disposed between seals 26*a* and 26*b* and hence is a dead head. FCU 38 port 24 is in bypass area 30*b*. Fluid in the mandrel 14 must flow through both of FCU 16 and FCU 38 and will skip the FCU 20 whose ports 22 and 24 are both disposed in bypass area 30*b*.

Figure 8:
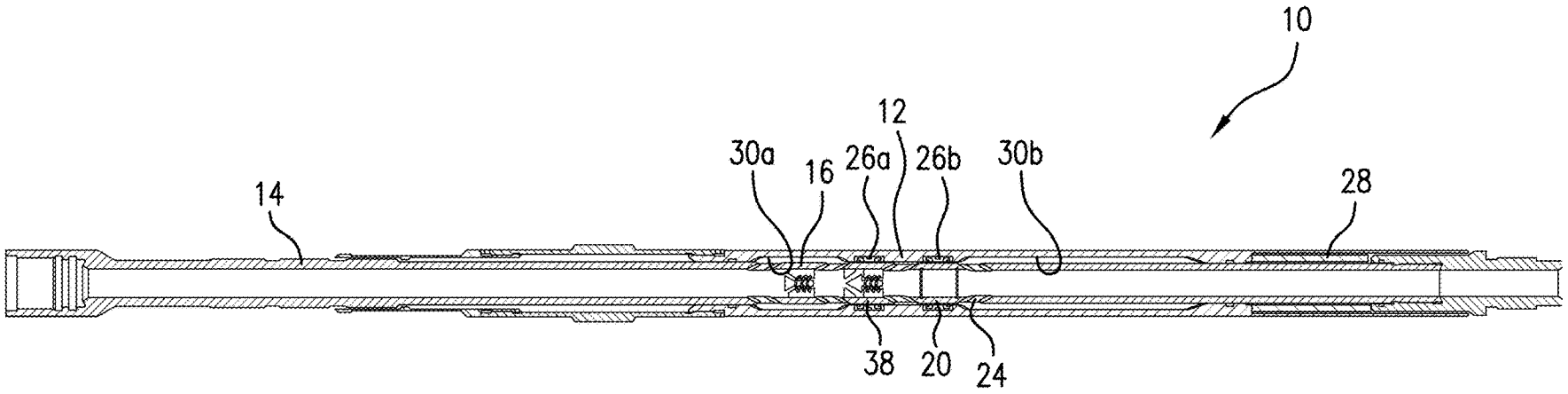
FIG. 8 is a sectional view of the tool of FIG. 5 in a position employing two different flow control units in series.

Referring to FIG. 8, mandrel 14 has been moved again relative to housing 12, which moves FCU 16 fully into bypass area 30*a* and FCU 38 and FCU 20 into position with seals 26*a* and 26*b*. In this configuration it is both FCU 38 and FCU 20 that will be in operation for any flow in the mandrel 14.

Figure 9:
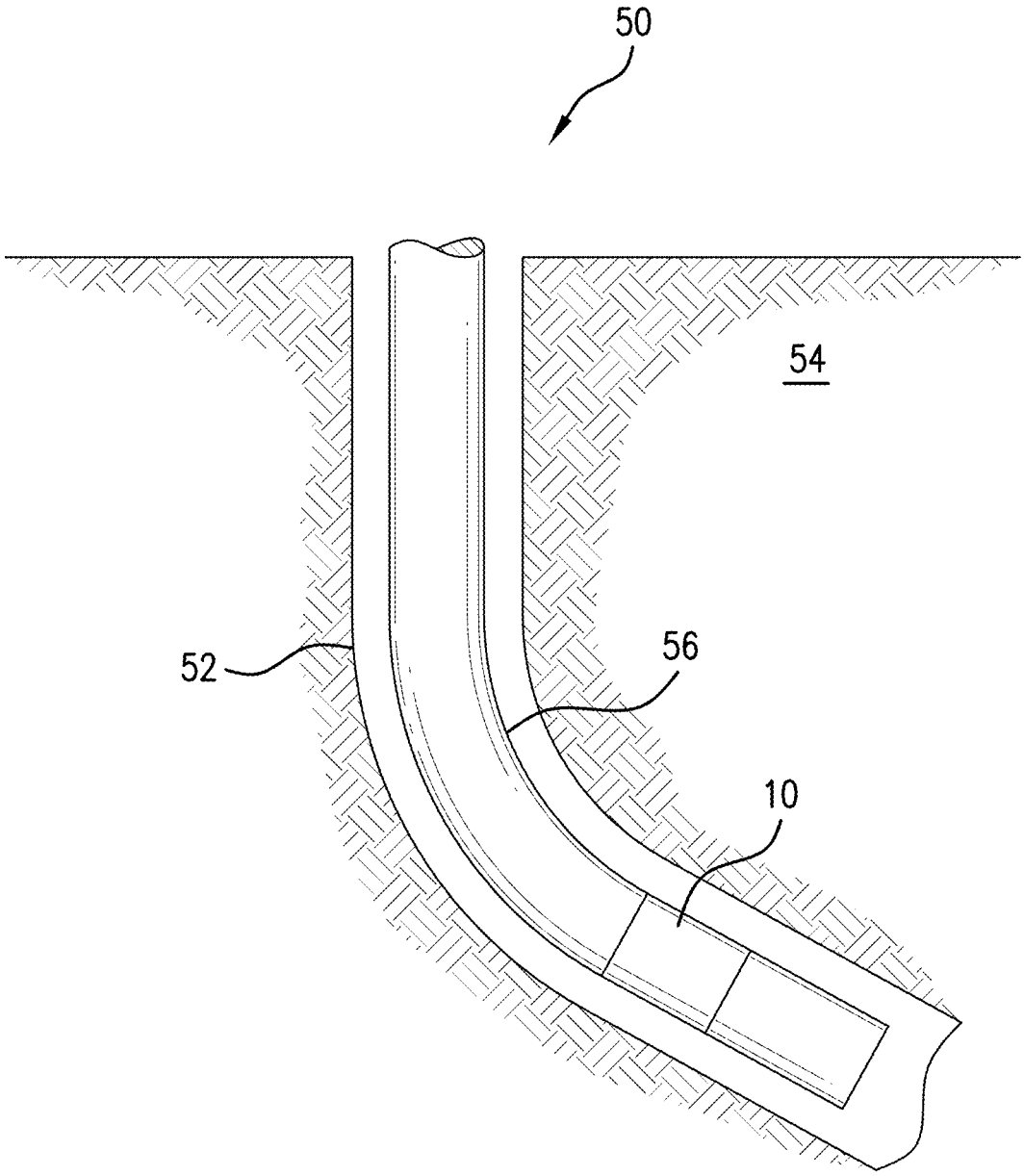
FIG. 9 is a view of a borehole system including the flow control tool as disclosed herein.
Figure 10:
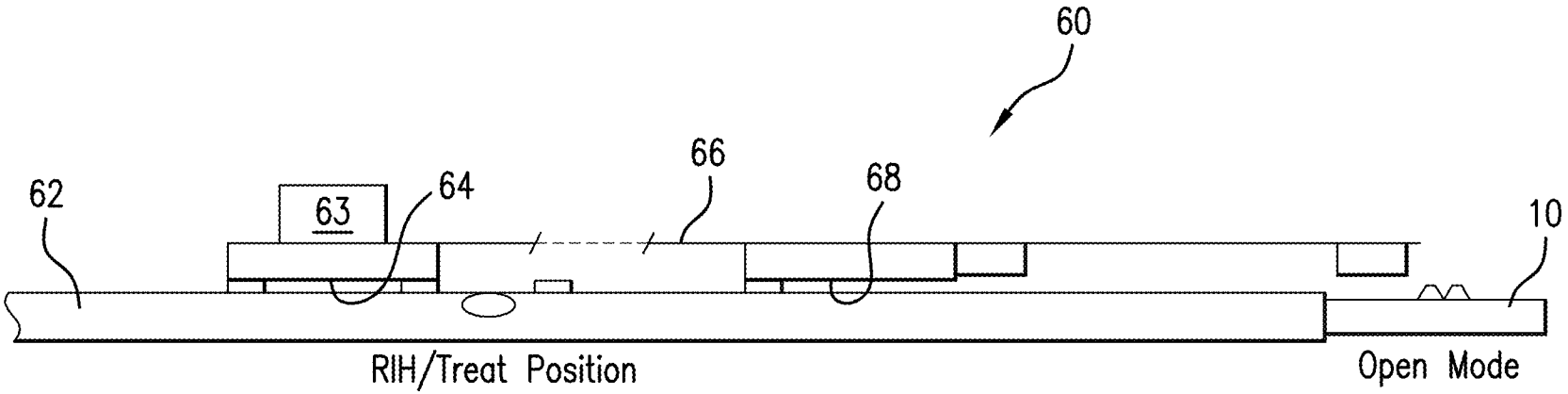
FIGS. 10-13 are views of a gravel pack assembly in various operational positions.
Figure 11:
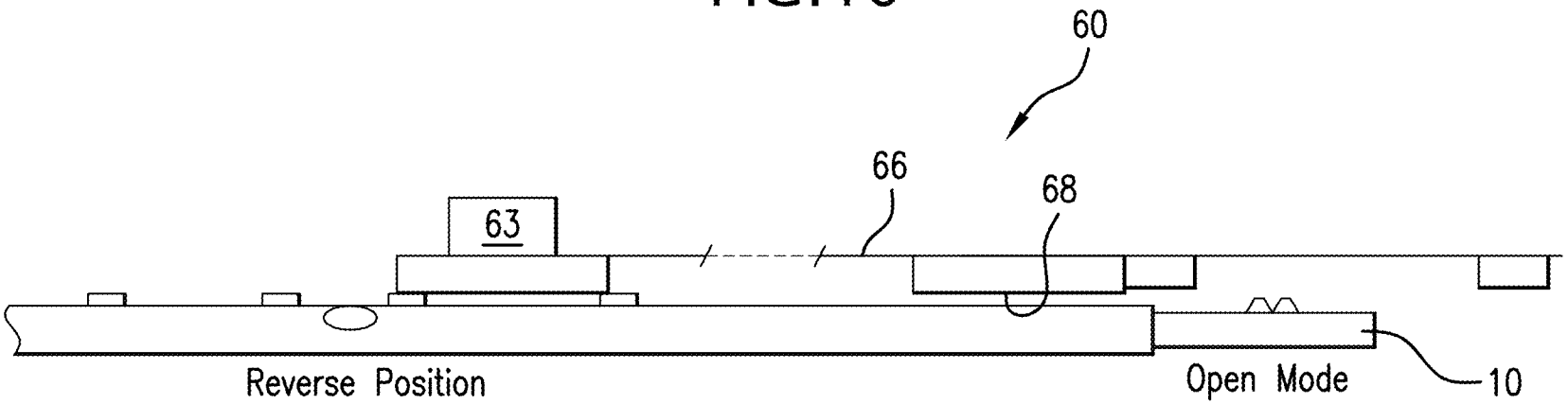

Referring to FIG. 9, a borehole system 50 is illustrated. The system 50 comprises a borehole 52 in a subsurface formation 54. A string 56 is disposed within the borehole 52. A tool 10 as disclosed herein is disposed within or as a part of the string 56.

In a particular embodiment referring to FIGS. 10-13 that illustrates some of the benefits of the disclosure hereof, a gravel pack assembly 60 includes a crossover tool 62, a packer 63, a first seal bore 64, a port housing 66, a second seal bore 68, and the tool 10 as described above. In the embodiment of assembly 60, tool 10 is configured with a check valve and a plug as FCUs. The assembly configured as such enables functional benefits not seen in the prior art. Specifically, the assembly may be placed in;

An OPEN mode: Bypass area(s) and ports are aligned so that flow may bypass around both FCUs;

A CHECK mode: Seal is adjacent to Check valve; bypass area is aligned so flow may bypass around Plug; and A CLOSED mode: Seal is adjacent to Plug; Flow through flow control tool 10 is blocked This is beneficial in that a CHECK mode allows confirmation of flow control tool's 10 selector cycle by application of hydraulic pressure against the check valve; clean fluid returns through Check valve during gravel pack circulation; Pressure can be applied against the check valve post gravel pack, before any tool movement takes place. This ensures that flow does not go the wrong way when tool movement reconfigures flow paths. Further, flow is reduced substantially in the checked direction of check valve or through the plug when closed. A small incidental or intentional leak, e.g. through a weephole 25, may occur in either CHECK or CLOSED mode.

Also due to the configuration of the indexer that allows for movement in the assembly 60 with or without something happening to the FCUs, the Crossover Tool can be moved between treatment and reverse positions multiple times while the FCU Tool remains in OPEN mode. This allows fluid flow through the entire assembly 60 from an uphole end to a downhole end. Additionally, this supports moving the flow control tool 10 without swabbing fluid from downhole of the assembly 60. This also supports accurate monitoring of bottomhole pressure using gauges (not shown) that are located uphole of the assembly 60.

Figure 12:
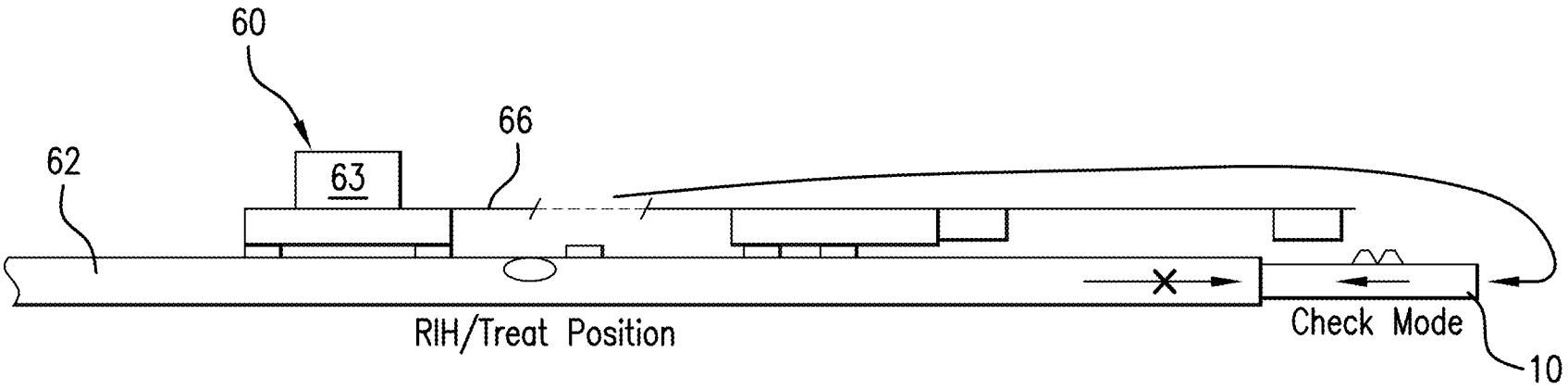
Figure 13:
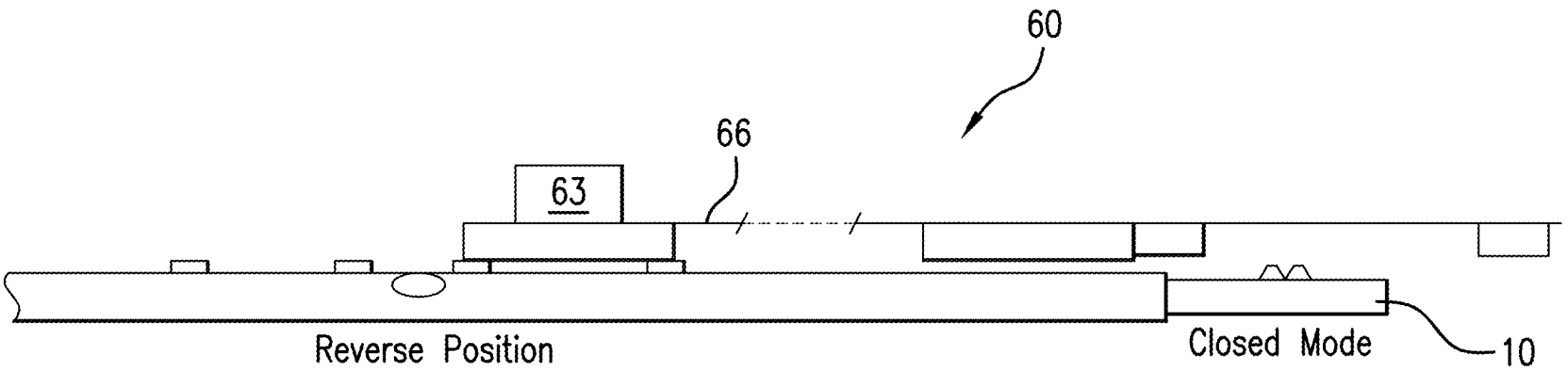

When desired, the assembly 60 mode of operation may be changed from OPEN to CHECK by picking up the crossover tool 62 above reverse position (FIG. 11) and returning the assembly to the treat position (FIG. 12).

After gravel packing is completed through assembly 60, an upward movement of the crossover tool 62 from TREAT (FIG. 12) to REVERSE (FIG. 13) position cycles the flow control tool 10 directly from CHECK to CLOSED.

The reverse position is also easily (automatically) confirmed with hydraulic pressure. Since the flow control tool 10 is put in CLOSED mode before the crossover tool 62 reaches the reverse position, it is reliably ensured that CLOSED mode has been achieved.

Set forth below are some embodiments of the foregoing disclosure:

Embodiment 1: A flow control tool includes a housing, a mandrel disposed in the housing, the mandrel supporting a plurality of discrete flow control units (FCU), and a seal disposed between the housing and the mandrel, the mandrel and housing being movable relative to one another to position the seal in an operative position for one of the plurality of FCUs.

Embodiment 2: The tool as in any prior embodiment, wherein the seal is affixed to the housing and the mandrel moves relative to the seal.

Embodiment 3: The tool as in any prior embodiment, wherein the housing includes a bypass area.

Embodiment 4: The tool as in any prior embodiment, wherein the mandrel includes openings at each axial end of each FCU of the plurality of discrete FCUs communicating an inside diameter flow path of the mandrel to the bypass area.

Embodiment 5: The tool as in any prior embodiment, wherein the openings adjacent a particular FCU of the plurality of discrete FCUs are positioned on opposite axial ends of the seal when the seal is in an operative position for that particular FCU.

Embodiment 6: The tool as in any prior embodiment, wherein the seal is a plurality of seals.

Embodiment 7: The tool as in any prior embodiment, wherein the plurality of seals are positionable relative to the mandrel to render a plurality of the plurality of discrete FCUs in an operative condition.

Embodiment 8: The tool as in any prior embodiment, wherein the plurality of FCUs in an operative condition operate in parallel with one another.

Embodiment 9: The tool as in any prior embodiment, wherein the plurality of FCUs in an operative condition operate in series with one another.

Embodiment 10: The tool as in any prior embodiment, wherein the plurality of discrete FCUs includes at least one of a check valve, a block, a metering nozzle, or a pressure regulator.

Embodiment 11: The tool as in any prior embodiment, further comprising an indexer.

Embodiment 12: A method for managing flow in a borehole includes shifting a mandrel having a plurality of discrete Flow Control Units (FCU) disposed therein into a position relative to a housing where a seal between the housing and the mandrel causes an FCU of the plurality of FCUs to be in an operational position, modifying a flow of fluid by passing the fluid through the FCU, and shifting a different FCU of the plurality of FCUs into an operational position.

Embodiment 13: The method as in any prior embodiment, further including modifying the flow of fluid by passing the fluid through the different FCU.

Embodiment 14: The method as in any prior embodiment, further including bypassing fluid around one of the FCU and the different FCU that is not in the operational position.

Embodiment 15: The method as in any prior embodiment, wherein the seal is a plurality of seals, at least two of the seals being in operational positions for two of the plurality of FCUs.

Embodiment 16: The method as in any prior embodiment, further modifying the fluid flow by passing the fluid through the FCU and the different FCU in parallel.

Embodiment 17: The method as in any prior embodiment, further modifying the fluid flow by passing the fluid through the FCU and the different FCU in series.

Embodiment 18: A gravel pack assembly includes a crossover tool, the tool as in any prior embodiment, connected to the crossover tool, a packer connected to the crossover tool, a first seal bore formed within the packer, a port housing connected to the packer, and a second seal bore connected to the port housing wherein the plurality of FCU's includes a check valve, and a plug, the assembly configured to change directly from check to closed.

Embodiment 19: A method for gravel packing includes operating a gravel pack assembly in an open mode, operating the gravel pack assembly in a check mode, and operating the gravel pack assembly in a closed mode.

Embodiment 20: A borehole system includes a borehole in a subsurface formation, a string in the borehole, and a tool as claimed in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A flow control tool, comprising:

a housing;

a mandrel disposed in the housing, the mandrel supporting a plurality of discrete flow control units (FCU) mounted in the mandrel; and a seal disposed between the housing and the mandrel, the mandrel and housing being movable relative to one another to position the seal in an operative position for one of the plurality of FCUs.

2. The tool as claimed in claim 1, wherein the seal is affixed to the housing and the mandrel moves relative to the seal.

3. The tool as claimed in claim 1, wherein the housing includes a bypass area.

4. The tool as claimed in claim 3, wherein the mandrel includes openings at each axial end of each FCU of the plurality of discrete FCUs communicating an inside diameter flow path of the mandrel to the bypass area.

5. The tool as claimed in claim 3, wherein the openings adjacent a particular FCU of the plurality of discrete FCUs are positioned on opposite axial ends of the seal when the seal is in an operative position for that particular FCU.

6. The tool as claimed in claim 1, wherein the seal is a plurality of seals.

7. The tool as claimed in claim 6, wherein the plurality of seals are positionable relative to the mandrel to render a plurality of the plurality of discrete FCUs in an operative condition.

8. The tool as claimed in claim 7, wherein the plurality of FCUs in an operative condition operate in series with one another.

9. The tool as claimed in claim 1, wherein the plurality of discrete FCUs includes at least one of a check valve, a block, a metering nozzle, or a pressure regulator.

10. The tool as claimed in claim 1, further comprising an indexer.

11. A gravel pack assembly comprising:

a crossover tool;

the tool as claimed in claim 1, connected to the cross over tool;

a packer connected to the crossover tool;

a first seal bore formed within the packer;

a port housing connected to the packer; and a second seal bore connected to the port housing, wherein the plurality of FCU's includes a check valve, and a plug, the assembly configured to change directly from check to closed.

12. A method for gravel packing comprising:

operating a gravel pack assembly including the tool as claimed in claim 1, in an open mode;

operating the gravel pack assembly in a check mode; and operating the gravel pack assembly in a closed mode.

13. A borehole system, comprising:

a borehole in a subsurface formation;

a string in the borehole; and a tool as claimed in claim 1, disposed within or as a part of the string.

14. A method for managing flow in a borehole, comprising:

shifting a mandrel having a plurality of discrete Flow Control Units (FCU) disposed in the mandrel into a position relative to a housing where a seal between the housing and the mandrel causes an FCU of the plurality of FCUs to be in an operational position;

modifying a flow of fluid by passing the fluid through the FCU; and shifting a different FCU of the plurality of FCUs into an operational position.

15. The method as claimed in claim 14, further including modifying the flow of fluid by passing the fluid through the different FCU.

16. The method as claimed in claim 14, further including bypassing fluid around one or more of the plurality of FCUs that are not in an operational position.

17. The method as claimed in claim 14, wherein the seal is a plurality of seals, at least two of the seals being in operational positions for two of the plurality of FCUs.

18. The method as claimed in claim 17, further modifying the fluid flow by passing the fluid through the FCU and the different FCU in series.

* * * * *